US010839827B2

(12) United States Patent
Kim et al.

(10) Patent No.: US 10,839,827 B2
(45) Date of Patent: Nov. 17, 2020

(54) METHOD FOR DETERMINING SOUND AND DEVICE THEREFOR

(71) Applicant: Samsung Electronics Co., Ltd., Suwon-si (KR)

(72) Inventors: Do-hyung Kim, Hwaseong-si (KR); Seok-hwan Jo, Suwon-si (KR); Jae-hyun Kim, Seoul (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 15/738,860

(22) PCT Filed: Jun. 26, 2015

(86) PCT No.: PCT/KR2015/006579
§ 371 (c)(1),
(2) Date: Dec. 21, 2017

(87) PCT Pub. No.: WO2016/208789
PCT Pub. Date: Dec. 29, 2016

(65) Prior Publication Data

US 2018/0182416 A1 Jun. 28, 2018

(51) Int. Cl.
*G10L 25/84* (2013.01)
*G10L 25/78* (2013.01)
*G10L 25/30* (2013.01)

(52) U.S. Cl.
CPC ..... *G10L 25/84* (2013.01); *G10L 25/30* (2013.01); *G10L 25/78* (2013.01)

(58) Field of Classification Search
CPC ..... G10L 25/30; G10L 25/78; G10L 25/84
See application file for complete search history.

(56) References Cited

U.S. PATENT DOCUMENTS 7,016,832 B2 * 3/2006 Choi ..... G10L 25/93 704/206
8,317,905 B2 11/2012 Varadaraj
2006/0080099 A1 * 4/2006 Thomas ..... G10L 15/10 704/243
2013/0144616 A1 * 6/2013 Bangalore ..... G10L 15/1822 704/226
2014/0222436 A1 * 8/2014 Binder ..... G06F 3/167 704/275
2014/0365225 A1 12/2014 Haiut
2015/0066498 A1 3/2015 Ma et al.
(Continued)

FOREIGN PATENT DOCUMENTS

JP 2012-220607 A 11/2012
JP 2015-102806 A 6/2015
(Continued)

OTHER PUBLICATIONS

Korean Office Action dated Feb. 19, 2019, issued in Korean Patent Application No. 10-2017-7036946.
(Continued)

*Primary Examiner* — Paras D Shah
(74) *Attorney, Agent, or Firm* — Jefferson IP Law, LLP

(57) ABSTRACT

A sound discriminating method comprises sensing a sound signal; changing the sensed sound signal into an electrical signal; and determining whether the electrical signal is a predetermined sound by analyzing the electrical signal.

18 Claims, 8 Drawing Sheets

(56) References Cited

U.S. PATENT DOCUMENTS

| | | | | |
|---|---|---|---|---|
| 2015/0066499 | A1* | 3/2015 | Wang | G10L 25/30 704/233 |
| 2015/0073799 | A1* | 3/2015 | Sun | G10L 25/78 704/246 |
| 2016/0066113 | A1* | 3/2016 | Elkhatib | H04R 29/004 381/56 |
| 2016/0284350 | A1* | 9/2016 | Yun | G10L 15/22 |
| 2016/0314805 | A1* | 10/2016 | Mortazavi | G10L 25/78 |
| 2017/0019703 | A1* | 1/2017 | Kim | H04N 21/4126 |

FOREIGN PATENT DOCUMENTS

| | | | |
|---|---|---|---|
| KR | 10-0198978 | B1 | 6/1999 |
| KR | 10-2010-0036893 | A | 4/2010 |
| KR | 10-2014-0059662 | A | 5/2014 |

OTHER PUBLICATIONS

Korean Office Action dated Aug. 5, 2019, issued in Korean Patent Application No. 10-2017-7036946.

* cited by examiner

| $O_v$ | $O_n$ | CONTROL MODULE OUTPUT |
|---|---|---|
| Low | Low | Off |
| Low | High | Off |
| **High** | **Low** | **On** |
| High | High | Off |

METHOD FOR DETERMINING SOUND AND DEVICE THEREFOR

TECHNICAL FIELD

The present disclosure relates to sound determining methods and apparatuses.

BACKGROUND ART

A voice trigger apparatus is an apparatus that is triggered when a voice command corresponding to a protocol is input and is a core application of an always-on sensing technology that is to be a key technology of the era of Internet of Things (IoT) and wearable devices. In the IoT era, communication between devices and between devices and people is important. In this regard, information will be information obtained by continuously monitoring surroundings of sensors attached to various surrounding things. A meaningful work that gives convenience and help to a user will be performed by sending and receiving the information. Always-on sensing technology is also important in the use of wearable devices. In terms of the nature of wearable devices, interaction with wearable devices and users is important, and new UXs are required through the use of data obtained through sensors, such as voice, face, and gestures. Also, in terms of the nature of wearable devices, the battery capacity requires low power operation in order to minimize the power consumption including a smart phone.

DETAILED DESCRIPTION OF THE INVENTION

Technical Problem

The present disclosure relates to sound determining methods and apparatuses.

Technical Solution

An embodiment provides a sound discriminating method. The sound discriminating method according to an embodiment may comprise: sensing a sound signal; changing the sensed sound signal into an electrical signal; and determining whether the electrical signal is a predetermined sound by analyzing the electrical signal.

The sound discriminating method according to an embodiment may further comprise amplifying the changed electrical signal.

The determining according to an embodiment may comprise: classifying the electrical signal into a voice signal and a noise signal.

The determining according to an embodiment may comprise: determining whether the electrical signal is a voice based on the classified voice signal and noise signal.

The sound discriminating method according to an embodiment may further comprise determining driving of a predetermined device based on the classified voice signal and noise signal.

The determining according to an embodiment may comprise: determining whether the electrical signal is the predetermined sound by using a deep neural network (DNN).

The predetermined sound according to an embodiment may comprise an applause sound or a finger bouncing sound.

Another embodiment provides a sound discriminating apparatus may comprise: a sensor configured to sense a sound signal; a signal changer configured to change the sensed sound signal into an electrical signal; and a determiner configured to determine whether the electrical signal is a predetermined sound by analyzing the electrical signal.

The sound discriminating apparatus according to another embodiment may further comprise a signal amplifier configured to amplify the changed electrical signal.

The determiner according to another embodiment may be configured to classify the electrical signal into a voice signal and a noise signal.

The determiner according to another embodiment may be configured to determine whether the electrical signal is a voice based on the classified voice signal and noise signal.

The sound discriminating apparatus according to another embodiment may further comprise a driving apparatus determiner configured to determine driving of a predetermined device based on the classified voice signal and noise signal.

The determiner according to another embodiment may be configured to determine whether the electrical signal is the predetermined sound by using a deep neural network (DNN).

The predetermined sound according to another embodiment may comprise an applause sound or a finger bouncing sound.

An embodiment may provide a non-transitory computer-readable recording medium having recorded thereon a program which, when executed by a computer, performs the method.

MODE FOR INVENTION

Figure 1:
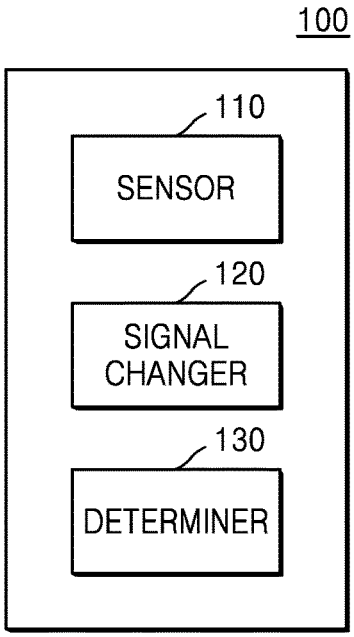
FIG. 1 is a diagram showing a configuration of a photograph discriminating apparatus according to an embodiment of the present disclosure.

Advantages and features of the present disclosure, and methods of achieving the same will be clearly understood with reference to the accompanying drawings and the following detailed embodiments. However, the present disclosure is not limited to the embodiments to be disclosed, but may be implemented in various different forms. The embodiments are provided in order to fully explain the present disclosure and fully explain the scope of the present disclosure for those skilled in the art. The scope of the present disclosure is defined by the appended claims. Meanwhile, the terms used herein are provided to only describe embodiments of the present disclosure and not for purposes of limitation. The same reference numbers denote the same elements throughout this specification.

First, the terms used in the present disclosure will be briefly described below before embodiments of the present disclosure are described in greater detail.

Most of the terms used herein are general terms that have been widely used in the technical art to which the present disclosure pertains. However, some of the terms used herein may be created reflecting intentions of technicians in this art, precedents, or new technologies. Also, some of the terms used herein may be arbitrarily chosen by the present applicant. In this case, these terms are defined in detail below. Accordingly, the specific terms used herein should be understood based on the unique meanings thereof and the whole context of the present disclosure.

In the present specification, it should be understood that the terms, such as 'including' or 'having,' etc., are intended to indicate the existence of the features, numbers, steps, actions, components, parts, or combinations thereof disclosed in the specification, and are not intended to preclude the possibility that one or more other features, numbers, steps, actions, components, parts, or combinations thereof may exist or may be added.

The term "unit" in the embodiments of the present disclosure means a software component or hardware components such as a field-programmable gate array (FPGA) or an application-specific integrated circuit (ASIC), and performs a specific function. However, the term "unit" is not limited to software or hardware. The "unit" may be formed so as to be in an addressable storage medium, or may be formed so as to operate one or more processors. Thus, for example, the term "unit" may refer to components such as software components, object-oriented software components, class components, and task components, processes, functions, properties, procedures, sub-routines, segments of program codes, drivers, firmware, micro codes, circuits, data, data base, data structures, tables, arrays, and parameters. Functions provided by the elements and "units" may be combined with a smaller number of elements and "units" or may be separated into additional elements and "units".

Hereinafter, embodiments of the present disclosure will be described in detail with reference to the accompanying drawings so that those skilled in the art may easily carry out the present disclosure. The present disclosure may, however, be embodied in many different forms and should not be construed as limited to the embodiments set forth herein. In order to clearly explain the present disclosure in the drawings, parts not related to the description will be omitted.

FIG. 1 is a diagram showing a configuration of a photograph discriminating apparatus 100 according to an embodiment of the present disclosure.

Referring to FIG. 1, the photograph discriminating apparatus 100 may include a sensor 110, a signal changer 120, and a determiner 130.

The sensor 110 may sense a sound signal. For example, the sensor 110 may include a sound sensor.

The signal changer 120 may change the sensed sound signal to an electrical signal. The signal changer 120 may include a sensor using a piezoelectric device. Also, the sensor 110 and the signal changer 120 may be combined to form a single piezoelectric device.

The determiner 130 may analyze the electrical signal to determine whether the electrical signal is a predetermined sound. For example, the predetermined sound may include a human voice. The predetermined sound may also include an applause sound or a finger bouncing sound. The determiner 130 may classify the electrical signal into a voice signal and a noise signal. In addition, the determiner 130 may determine whether the electrical signal is voice based on the classified voice signal and noise signal. The determiner 130 may determine whether the electrical signal is a predetermined sound by using a Deep Neural Network (DNN).

The sensor 110 and the signal changer 120 may be implemented as a single flexible inorganic piezoelectric acoustic nanosensor. The flexible inorganic piezoelectric acoustic nanosensor may use a piezoelectric thin film to simulate functions of a basement membrane of the cochlea and hair cells and, if voice is input, mechanically separate a frequency of the sound signal. A microphone, an A/D converter, and a DSP or HW for driving a frequency analysis algorithm are required. These may be replaced with a single piezoelectric device. In terms of the nature of the device, the device may be driven at low power, which helps improve power consumption. According to a position of an electrode attached to the device, a signal of which frequency band to be analyzed may be changed. According to the number of electrodes, frequencies of how many bands to be analyzed may be different. As the number of electrodes increases, the frequency resolution becomes larger, and a circuit of the voice determiner also becomes larger, and thus the power consumption increases.

The determiner 130 receives the signals output from the sensor 110 and the signal changer 120 and outputs two signals, i.e., presence or absence of the voice signal and a noise sound. A control module of a voice determiner outputs on/off signals of a microphone that is a voice trigger device, an A/D converter, and a voice recognizer according to an output signal of a voice/anti-voice determination module.

Figure 2:
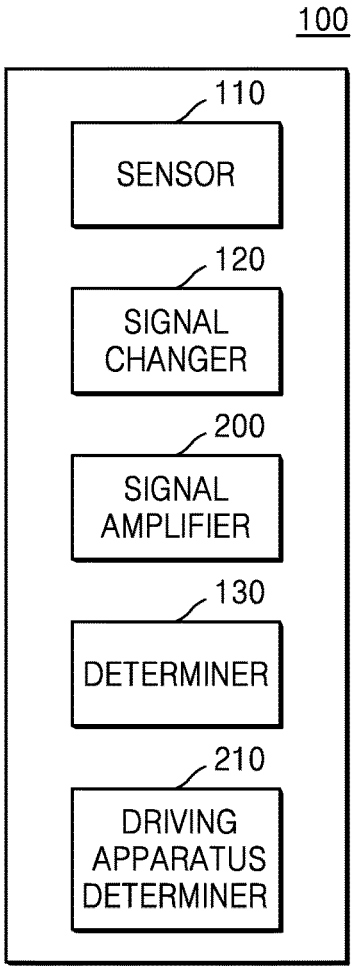
FIG. 2 is a diagram showing a configuration of a photograph discriminating apparatus according to another embodiment of the present disclosure.

FIG. 2 is a diagram showing a configuration of the photograph discriminating apparatus 100 according to another embodiment of the present disclosure.

Referring to FIG. 2, the photograph discriminating apparatus 100 may include the sensor 110, the signal changer 120, a signal amplifier 200, the determiner 130, and a driving apparatus determiner 210.

The sensor 110 may sense a sound signal. For example, the sensor 110 may include a sound sensor.

The signal changer 120 may change the sensed sound signal to an electrical signal. The signal changer 120 may include a sensor using a piezoelectric device. Also, the sensor 110 and the signal changer 120 may be combined to form a single piezoelectric device. For example, the piezoelectric device may detect the sound signal and change the sensed sound signal into an electrical signal just as the signal changer 120 changes the sound signal sensed by the sensor 110 to the electrical signal.

The determiner 130 may analyze the electrical signal to determine whether the electrical signal is a predetermined sound. For example, the predetermined sound may include a human voice. The predetermined sound may also include an applause sound or a finger bouncing sound. The determiner 130 may classify the electrical signal into a voice signal and a noise signal. In addition, the determiner 130 may determine whether the electrical signal is voice based on the classified voice signal and noise signal. The determiner 130 may determine whether the electrical signal is a predetermined sound by using a Deep Neural Network (DNN).

The sensor 110 and the signal changer 120 may be implemented as a single flexible inorganic piezoelectric acoustic nanosensor. The flexible inorganic piezoelectric acoustic nanosensor may use a piezoelectric thin film to simulate functions of a basement membrane of the cochlea and hair cells and, if voice is input, mechanically separate a frequency of the sound signal. A microphone, an A/D converter, and a DSP or HW for driving a frequency analysis algorithm are required. These may be replaced with a single piezoelectric device. In terms of the nature of the device, the device may be driven at low power, which helps improve power consumption. According to a position of an electrode attached to the device, a signal of which frequency band to be analyzed may be changed. According to the number of electrodes, frequencies of how many bands to be analyzed may be different. As the number of electrodes increases, the frequency resolution becomes larger, and a circuit of the voice determiner also becomes larger, and thus the power consumption increases.

The determiner 130 receives the signals output from the sensor 110 and the signal changer 120 and outputs two signals, i.e., presence or absence of the voice signal and a noise sound. A control module of a voice determiner outputs on/off signals of a microphone that is a voice trigger device, an A/D converter, and a voice recognizer according to an output signal of a voice/anti-voice determination module.

The signal amplifier 200 may amplify the changed electrical signal. Since a piezoelectric device output signal of the sensor 110 is smaller than a signal processed in an actual analog circuit, the signal is amplified through the signal amplifier 200.

The driving apparatus determiner 210 may determine driving of a predetermined apparatus based on the classified voice signal and noise signal.

Figure 3:
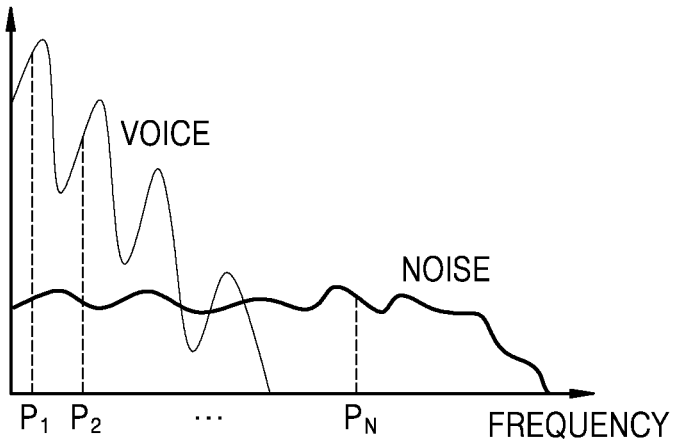
FIGS. 3 to 8 are diagrams for explaining a photograph discriminating method according to an embodiment of the present disclosure.

FIGS. 3 to 8 are diagrams for explaining a photograph discriminating method according to an embodiment of the present disclosure. Referring to FIG. 3, a process of classifying electrical signals into voice signals and noise signals may be described. Referring to a graph, P1 and P2 correspond to low frequency regions. The closer to Pn, the closer to a high frequency region. Also, in the graph, voice signals are concentrated on a low frequency part. For example, the voice signals are concentrated on a frequency band of about 4 kHz or less. On the other hand, noise signals are uniformly distributed in frequencies of the entire band. Therefore, it is possible to classify voice signals by separating parts correlated with a low frequency band.

Figure 4:
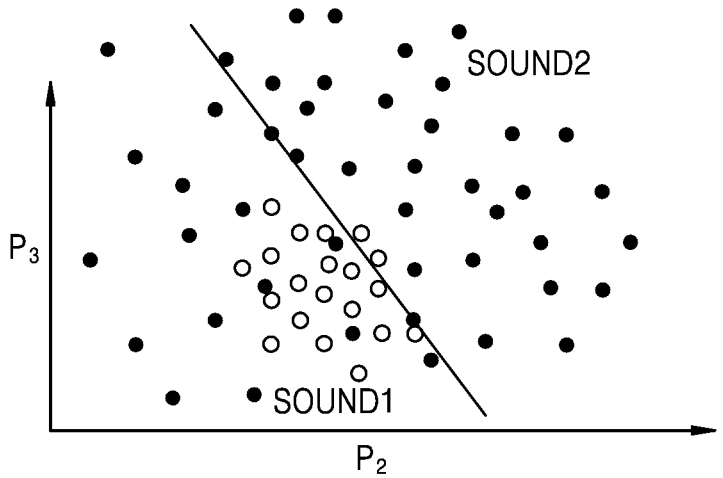
Figure 5:
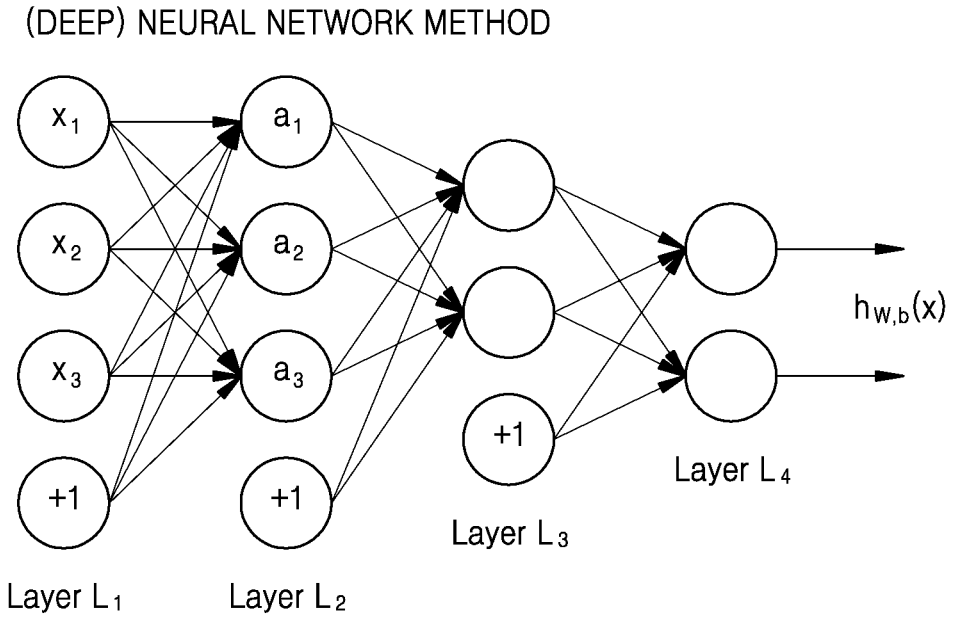

Referring to FIGS. 4 and 5, a sound discriminating method using a deep neural network (DNN) to classify sound 1 and sound 2 in FIG. 4 may be described. The DNN is an Artificial Neural Network (ANN) consisting of a plurality of hidden layers between an input layer and an output layer. Referring to FIG. 5, the DNN is a method of collecting information step by step closer to layer L1, layer L2, layer L3, and layer L4 and deriving a result.

Figure 6:
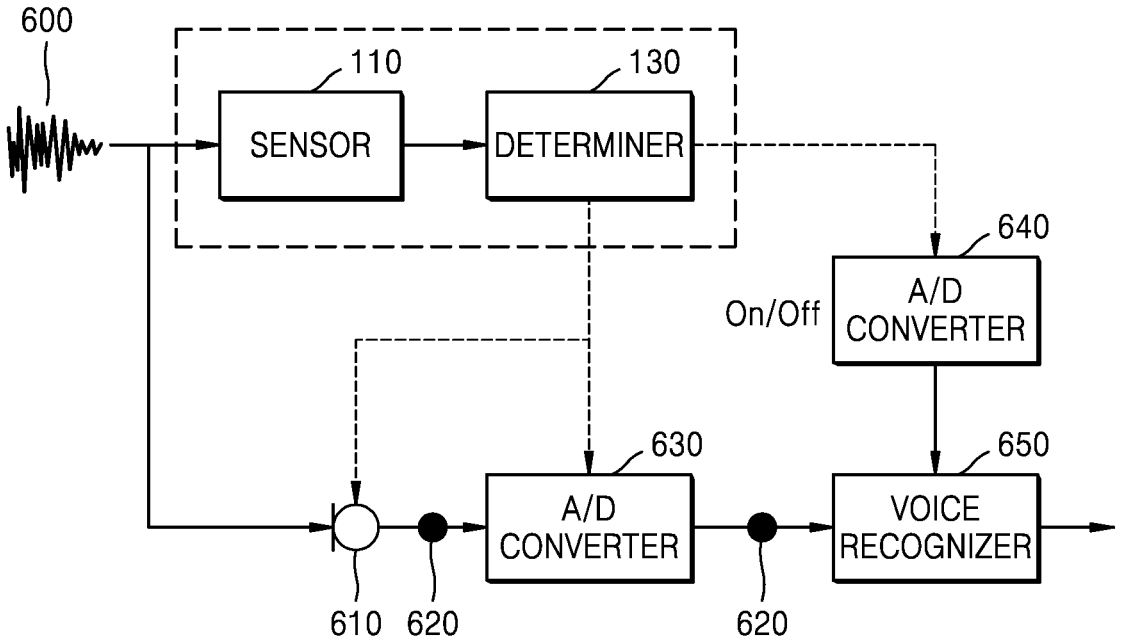

Referring to FIG. 6, another embodiment of a sound discriminating apparatus may be described. A sound 600 may be sensed by the sensor 110. The determiner 130 may determine whether the sensed sound is voice or noise. The determiner 130 may operate two A/D converters 630 and 640 and a microphone 610 when the sensed sound is voice. Thereafter, the microphone 610 may receive the sound 600. The input sound 600 may be amplified through a buffer 620. The amplified sound 600 may be converted into a digital signal by the A/D converter 630. The converted digital signal may then be amplified through the buffer 620. Also, a voice recognizer 650 may recognize which voice is the amplified digital signal.

Figures 7, 8:
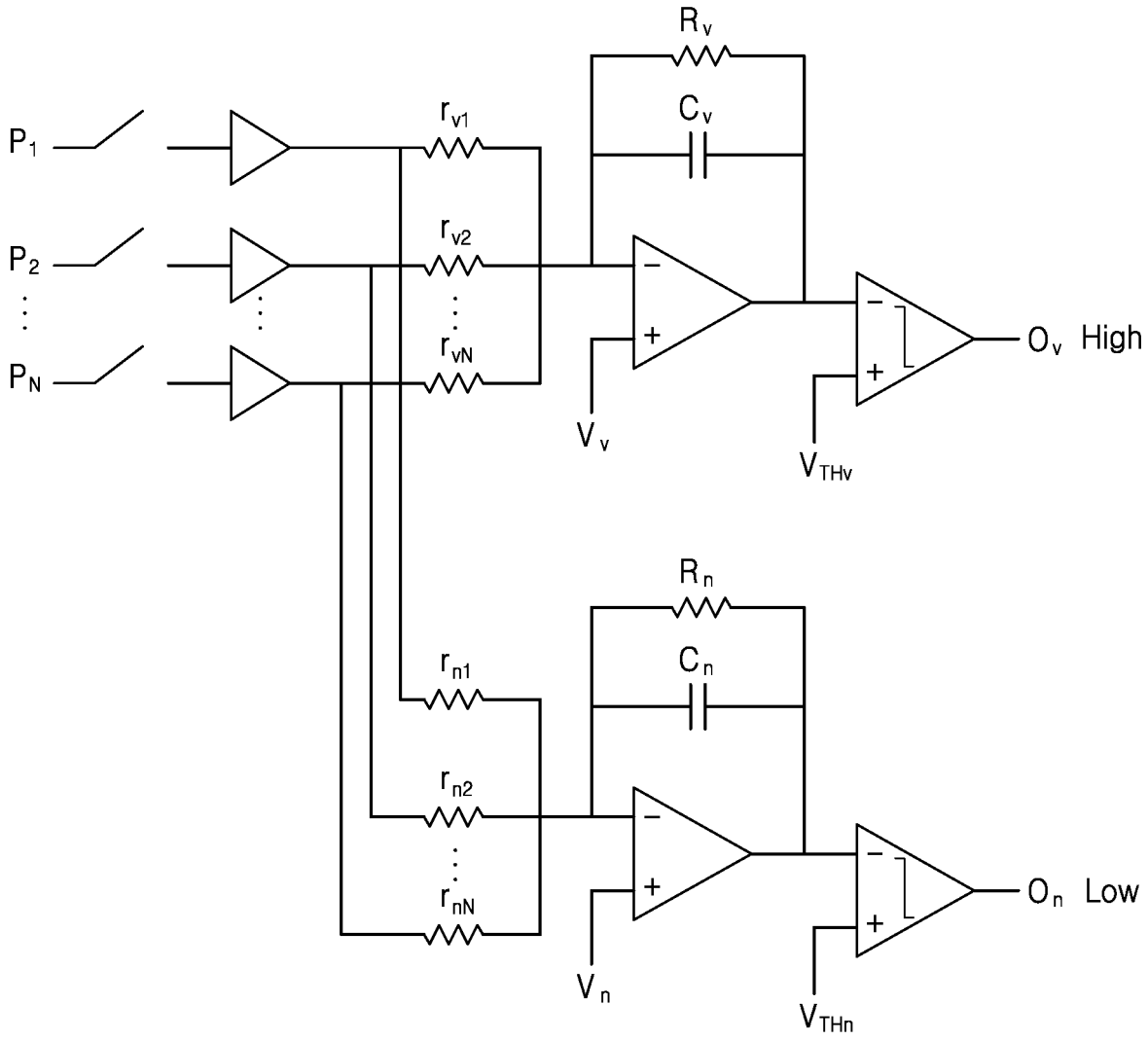

FIGS. 7 and 8 illustrate examples in which a sound discriminating apparatus is implemented as a device. Referring to FIG. 7, P1 to Pn may be sound corresponding to various frequency bands. rv1 through rvn are resistances for classifying voice from sound. rn1 through rnn are resistances for classifying noise. Also, Rv and Cv may classify voice corresponding to low frequencies. Vv and Vthv are applied voltages for operating opamp classifying voice. Rn and Cn may also classify noise. Vn and Vthn are applied voltages for operating opamp classifying voice.

A circuit associated with opamp at the bottom of the figure is set to allow a large amount of current to flow when a noise signal is input. That is, a resistor connected to a frequency band in which many voice signals are distributed has a great value, while a resistor connected to a frequency band in which less voice signals are distributed has a small value. Thus, when a non-voice signal is input, a large amount of current flows in a channel other than a voice signal band compared to another signal band. Thus, the current that has passed through a resistor circuit will be summed up in an integration circuit and an output voltage of the integration circuit will drop more rapidly when the non-voice signal is input. When an output voltage value of the integration circuit falls and becomes lower than a threshold voltage value of a comparison circuit, a logically high value is output.

A high or low signal is output through each block, a control module calculates a combination of the high and low signals, and thus an on/off signal of a voice trigger apparatus is finally output.

Referring to FIG. 8, when current Ov from opamp classifying voice is high and current On from opamp classifying noise is low by comparing intensity of the current through opamp, sound may be determined as voice. In response, a driving apparatus may be determined to drive.

However, when the current Ov from opamp classifying voice is low and the current On from opamp classifying noise is low by comparing the intensity of the current through opamp, sound may not be determined as voice. Also, when the current Ov from opamp classifying voice is low and the current On from opamp classifying noise is high by comparing the intensity of the current through opamp, sound may not be determined as voice. Finally, when the current Ov from opamp classifying voice is high and the current On from opamp classifying noise is low by comparing the intensity of the current through opamp, sound may not be determined as voice.

An amplified electrode signal for each frequency passes through a resistance circuit for determining whether voice has been input. This resistance circuit is set to allow a large amount of current to flow when voice is input in accordance with a characteristic of a voice signal. That is, a resistance connected to a frequency band in which many voice signals are distributed has a small value, whereas a resistance connected to a frequency band in which less voice signals are distributed has a great value. Thus, if the voice signal is input, a large amount of current flows in a voice signal band compared to other signal bands. Thus, the current that passed through the resistance circuit is summed in an integration circuit. When the current is input to the integration circuit, the current is stored in a storage battery of the integration circuit and an output voltage value of the integrating circuit is reduced. A speed at which the output voltage value of the integration circuit is reduced will drop at a faster rate when a greater amount of current is input, that is, when the voice signal is input. When the output voltage value of the integrating circuit is reduced and becomes lower than a threshold voltage value of a comparison circuit, a logically high value is output. The resistance of the integrating circuit is put in order to create a leaky path. That is, there is a resistor to drop a storage battery voltage of the integration circuit for a next input, and two RC time constants will cause the voltage accumulated in the storage battery to disappear.

Figure 9:
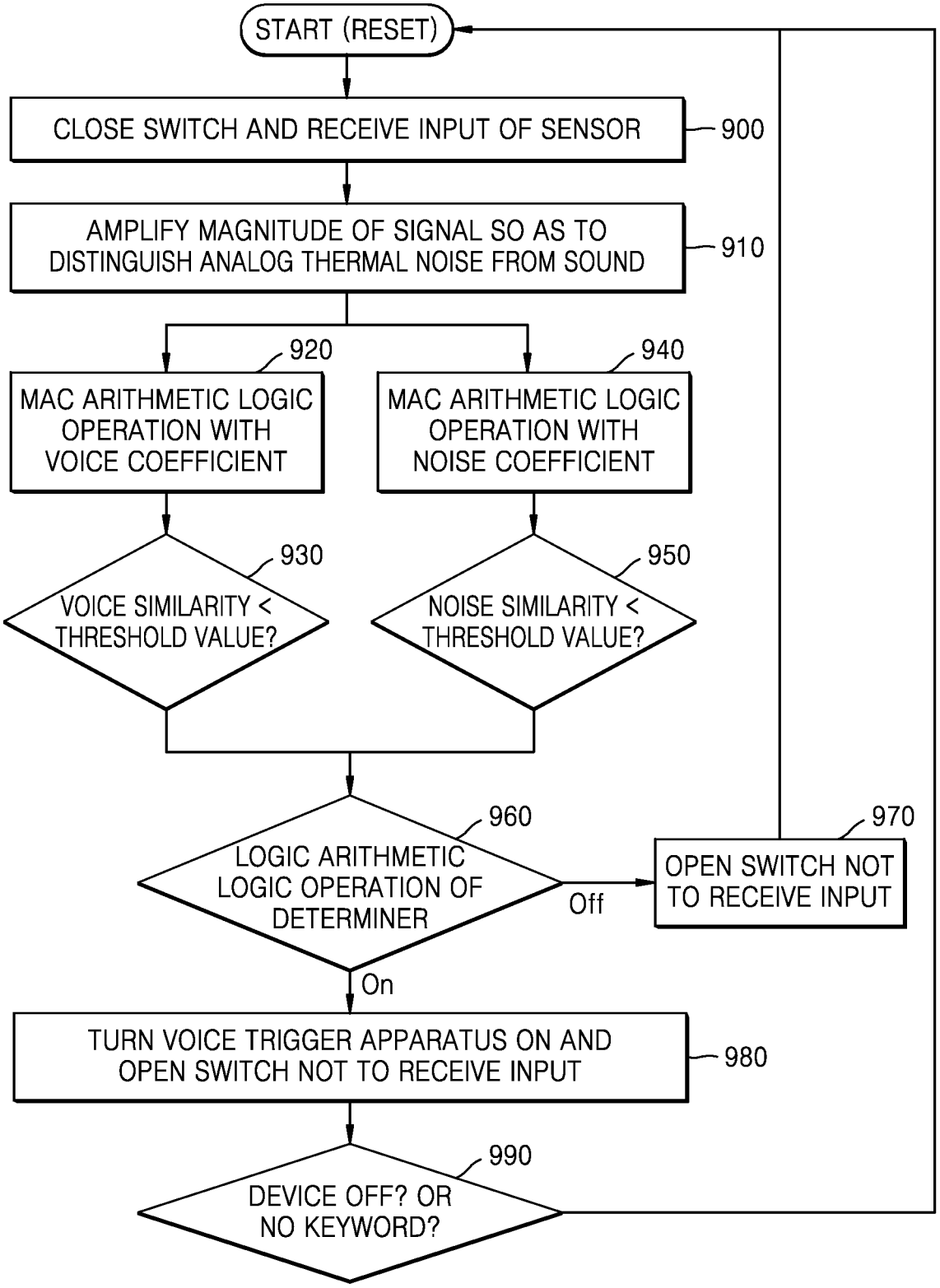
FIG. 9 is a flowchart showing a photograph discriminating method according to an embodiment of the present disclosure.

FIG. 9 is a flowchart showing a photograph discriminating method according to an embodiment of the present disclosure. This may be explained with reference to a circuit diagram of FIG. 7.

In step 900, a switch may be closed and a sensor may receive sound.

In step 910, magnitude of a signal may be amplified to distinguish analog thermal noise from the sound.

In step 920, MAC arithmetic logic operation may be performed on the amplified signal with a voice coefficient. The MAC arithmetic logic operation means multiplication and then accumulation operations.

In step 930, it is determined whether a voice similarity is smaller than a predetermined threshold value.

In step 940, the MAC arithmetic logic operation may be performed on the amplified signal with a noise coefficient.

In step 950, it is determined whether a noise similarity is smaller than a predetermined threshold value.

In step 960, a determiner may perform a logic arithmetic logic operation.

In step 970, if sound is not determined as voice as a result of the logic arithmetic logic operation of the determiner, the switch may be opened not to receive sound.

In step 980, a voice trigger apparatus may be turned on and the switch may be opened such that the sensor may not receive an input. For example, devices except a microphone may all be turned off. Also, the voice trigger apparatus continuously monitors a signal input to the microphone. If an input voice is a voice command that conforms to a previously promised rule, a predetermined device is turned on. That is, since the predetermined device is turned on only when the voice command is applied and the voice is triggered, the power consumption may be reduced.

That is, during a time when no sound is input, both the microphone that is the voice trigger apparatus, an A/D converter, and a DSP for driving a voice recognizer are all turned off, and a piezoelectric device for a cochlear implant and an analog voice activator apparatus may be driven at ultra low power. When a voice comes in, the voice activator apparatus recognizes the voice and thus the existing voice trigger apparatus is turned on and performs a voice trigger operation. With this method, the power consumption may be reduced by turning off all apparatuses including the microphone in addition to the voice activator apparatus during the time when no voice is input.

When the sound discriminating apparatus 100 is used in conjunction with the voice trigger apparatus, the power consumption may be dramatically reduced. The sensor 110 using a piezoelectric device may be driven at low power, and the determiner 130 is also configured as an analog circuit and thus consumes power much smaller than that of a digital circuit. Thus, the voice trigger apparatus may be driven at low power, thereby enhancing the user convenience. As a result, a battery use time is increased, and thus an effective user may be possible. The sound discriminating method is not limited to a voice trigger, but may also be applied to an IoT sensor hub. Since it is unknown what time and from which sensing information of many IoT sensors come in, the IoT sensor hub is always on. The IoT sensor hub is driven at low power when there is no sensing information by applying the sound discriminating method according to an embodiment and operates only when the sensing information comes in, thereby helping reduce power consumption.

Figure 10:
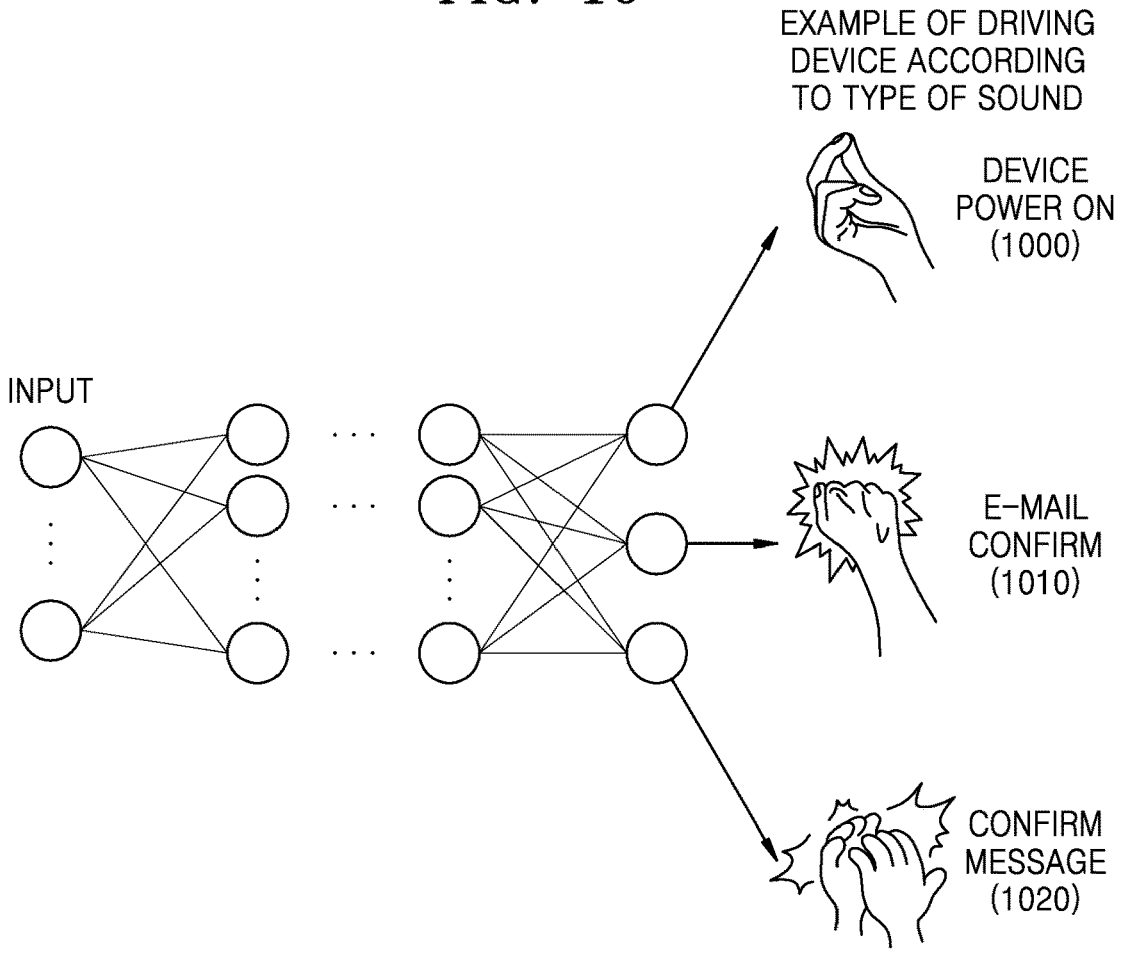
FIG. 10 is a diagram showing various examples of a photograph discriminating method of the present disclosure.

FIG. 10 is a diagram showing various examples of a photograph discriminating method of the present disclosure. According to FIG. 10, when the determiner 130 determines sound sensed by the sensor 110 as sound of flicking a finger, the photograph discriminating apparatus 100 may turn on a predetermined device. Also, the photograph discriminating apparatus 100 may confirm an e-mail when the determiner 130 determines the sound sensed by the sensor 110 as knocking sound. Also, when the determiner 130 determines the sound sensed by the sensor 110 as a sound of applause, the photograph discriminating apparatus 100 may confirm a message of the predetermined device. The predetermined device may include a smart phone and a smart watch. However, the sound that the determiner 130 may determine is not limited to the above, and various sounds may be determined. Also, the apparatus 100 may also perform a variety of operations corresponding to the sound determined by the determiner 130, without being limited to the above-described operations.

Figure 11:
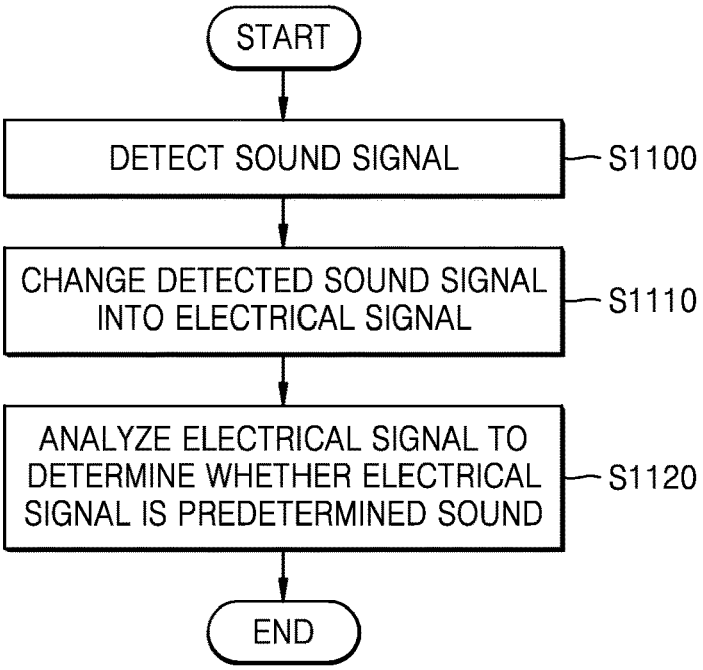
FIG. 11 is a flowchart showing a photograph discriminating method according to an embodiment of the present disclosure.

FIG. 11 is a flowchart showing a photograph discriminating method according to an embodiment of the present disclosure.

According to step S1100, a sound signal may be detected.

According to step S1110, the detected sound signal may be changed into an electrical signal.

According to step S1120, the electrical signal may be analyzed to determine whether the electrical signal is a predetermined sound.

Figure 12:
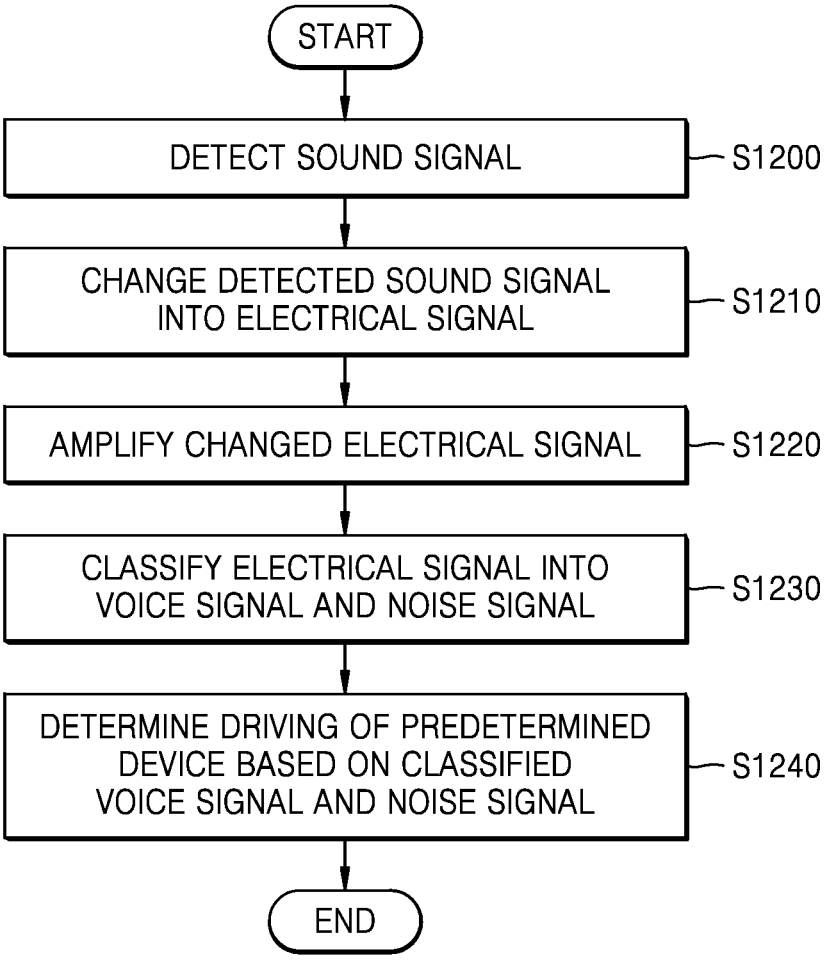
FIG. 12 is a flowchart showing a photograph discriminating method according to another embodiment of the present disclosure.

FIG. 12 is a flowchart showing a photograph discriminating method according to another embodiment of the present disclosure.

According to step S1200, a sound signal may be detected.

According to step S1210, the detected sound signal may be changed into an electrical signal.

According to step S1220, the changed electrical signal may be amplified.

According to step S1230, the electrical signal may be classified into a voice signal and a noise signal.

According to step S1240, it is possible to determine driving of the predetermined device based on the classified voice signal and noise signal.

Figure 13:
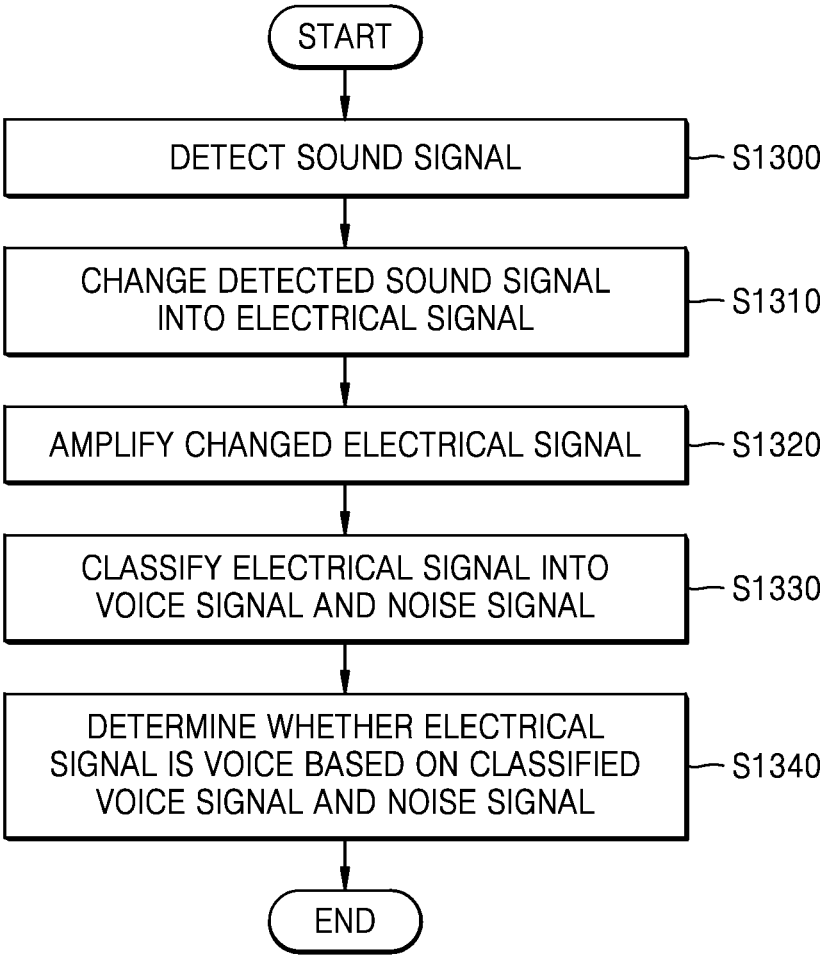
FIG. 13 is a flowchart showing a photograph discriminating method according to another embodiment of the present disclosure.

FIG. 13 is a flowchart showing a photograph discriminating method according to another embodiment of the present disclosure.

According to step S1300, a sound signal may be detected.

According to step S1310, the detected sound signal may be changed into an electrical signal.

According to step S1320, the changed electrical signal may be amplified.

According to step S1330, the electrical signal may be classified into a voice signal and a noise signal.

According to step S1340, it is possible to determine whether the electrical signal is voice based on the classified voice signal and noise signal.

The device described herein may include a processor, a memory for storing and executing program data, a permanent storage such as a disk drive, a communication port for handling communications with external devices, and user interface devices, including a display, keys, etc. When software modules are involved, these software modules may be stored as program instructions or computer readable codes executable on the processor on a computer-readable media such as read-only memory (ROM), random-access memory (RAM), CD-ROMs, magnetic tapes, floppy disks, and optical data storage devices. The computer readable recording medium may also be distributed over network coupled computer systems so that the computer readable code is stored and executed in a distributed fashion. The media may be read by the computer, stored in the memory, and executed by the processor.

All references, including publications, patent applications, and patents, cited herein are hereby incorporated by reference to the same extent as if each reference were individually and specifically indicated to be incorporated by reference and were set forth in its entirety herein.

The present disclosure may be described in terms of functional block components and various processing steps. Such functional blocks may be realized by any number of hardware and/or software components configured to perform the specified functions. For example, the present disclosure may employ various integrated circuit components, e.g., memory elements, processing elements, logic elements, look-up tables, and the like, which may carry out a variety of functions under the control of one or more microprocessors or other control devices. Similarly, where the elements of the present disclosure are implemented using software programming or software elements the disclosure may be implemented with any programming or scripting language such as C, C++, Java, assembler, or the like, with the various algorithms being implemented with any combination of data structures, objects, processes, routines or other programming elements. Functional aspects may be implemented in algorithms that execute on one or more processors. Furthermore, the present disclosure could employ any number of conventional techniques for electronics configuration, signal processing and/or control, data processing and the like. The words "mechanism" and "element" are used broadly and are not limited to mechanical or physical embodiments, but may include software routines in conjunction with processors, etc.

The particular implementations shown and described herein are illustrative examples of the disclosure and are not intended to otherwise limit the scope of the disclosure in any way. For the sake of brevity, conventional electronics, control systems, software development and other functional aspects of the systems (and components of the individual operating components of the systems) may not be described in detail. Furthermore, the connecting lines, or connectors shown in the various figures presented are intended to represent exemplary functional relationships and/or physical or logical couplings between the various elements. It should be noted that many alternative or additional functional relationships, physical connections or logical connections may be present in a practical device. Moreover, no item or component is essential to the practice of the disclosure unless the element is specifically described as "essential" or "critical".

The use of the terms "a" and "an", and "the" and similar referents in the context of describing the disclosure (especially in the context of the following claims) are to be construed to cover both the singular and the plural. Furthermore, recitation of ranges of values herein are merely intended to serve as a shorthand method of referring individually to each separate value falling within the range, unless otherwise indicated herein, and each separate value is incorporated into the specification as if it were individually recited herein. Finally, the steps of all methods described herein may be performed in any suitable order unless otherwise indicated herein or otherwise clearly contradicted by context. The use of any and all examples, or exemplary language (e.g., "such as") provided herein, is intended merely to better illuminate the disclosure and does not pose a limitation on the scope of the disclosure unless otherwise claimed. Numerous modifications and adaptations will be readily apparent to those of ordinary skill in this art without departing from the spirit and scope of the present disclosure.

The invention claimed is:

1. A sound discriminating method comprising:

sensing a sound signal and converting the sensed sound signal into an electrical signal using a piezoelectric acoustic sensor;

performing, by a determiner circuit, a multiplier-accumulator (MAC) arithmetic logic operation on the electrical signal using a voice coefficient, and on the electrical signal using a noise coefficient;

in response to performing the MAC arithmetic logic operation, comparing, by the determiner circuit, a voice similarity with a predetermined voice threshold, and a noise similarity with a predetermined noise threshold;

determining, by the determiner circuit, whether the electrical signal corresponds to a predetermined sound based on a result of comparing the voice similarity with the predetermined voice threshold and the noise similarity with the predetermined noise threshold; and outputting, by the determiner circuit, a drive signal to activate a microphone based on determining that the electrical signal corresponds to the predetermined sound, wherein the microphone is turned off until the drive signal is outputted.

2. The sound discriminating method of claim 1, further comprising:

amplifying the electrical signal.

3. The sound discriminating method of claim 1, wherein the determining further comprises determining whether the electrical signal includes a voice of a person based on the electrical signal.

4. The sound discriminating method of claim 1, further comprising:

determining driving of a predetermined device based on the electrical signal.

5. The sound discriminating method of claim 1, wherein the determining comprises determining whether the electrical signal corresponds to the predetermined sound by using a deep neural network (DNN).

6. The sound discriminating method of claim 1, wherein the predetermined sound comprises an applause sound or a finger bouncing sound.

7. The sound discriminating method of claim 1, wherein the drive signal is further configured to activate a first analog-to-digital converter.

8. A non-transitory computer-readable storage medium configured to store one or more computer programs including instructions that, when executed by at least one processor, cause the at least one processor to control for the method of claim 1.

9. A sound discriminating apparatus comprising:

a piezoelectric acoustic sensor configured to sense a sound signal and convert the sensed sound signal into an electrical signal;

a microphone; and a determiner circuit configured to:

perform a multiplier-accumulator (MAC) arithmetic logic operation on the electrical signal using a voice coefficient, and on the electrical signal using a noise coefficient, in response to performing the MAC arithmetic logic operation, compare a voice similarity with a predetermined voice threshold, and a noise similarity with a predetermined noise threshold, determine whether the electrical signal corresponds to a predetermined sound based on a result of comparing the voice similarity with the predetermined voice threshold and the noise similarity with the predetermined noise threshold, and output a drive signal to activate the microphone based on determining that the electrical signal corresponds to the predetermined sound, wherein the microphone is turned off until the drive signal is outputted.

10. The sound discriminating apparatus of claim 9, further comprising:

a signal amplifier configured to amplify the electrical signal.

11. The sound discriminating apparatus of claim 9, wherein the determiner circuit is further configured to determine whether the electrical signal corresponds to a voice based on the electrical signal.

12. The sound discriminating apparatus of claim 9, wherein the determiner circuit is further configured to determine driving of a predetermined device based on the electrical signal.

13. The sound discriminating apparatus of claim 9, wherein the determiner circuit is further configured to determine whether the electrical signal corresponds to the predetermined sound by using a deep neural network (DNN).

14. The sound discriminating apparatus of claim 9, wherein the predetermined sound comprises an applause sound or a finger bouncing sound.

15. The sound discriminating method of claim 7, further comprising, in response to the electrical signal corresponding to the predetermined sound based on the result of the comparing, outputting a second drive signal to activate a second analog-to-digital converter.

16. The sound discriminating apparatus of claim 9, wherein the drive signal is further configured to activate a first analog-to-digital converter.

17. The sound discriminating apparatus of claim 16, wherein the determiner circuit is further configured to, in response to the electrical signal corresponding to the predetermined sound based on the result of the comparison, output a second drive signal to activate a second analog-to-digital converter.

18. The sound discriminating apparatus of claim 9, wherein the determiner circuit comprises:

a first integration circuit configured to integrate the electrical signal to determine whether frequencies in the electrical signal correspond to a voice signal; and a second integration circuit configured to integrate the electrical signal to determine whether frequencies in the electrical signal correspond to a noise signal.

* * * * *